US011293172B1

(12) United States Patent
Jones et al.

(10) Patent No.: US 11,293,172 B1
(45) Date of Patent: Apr. 5, 2022

(54) SYSTEMS AND METHODS FOR TOILET VENTILATION

(71) Applicant: Ecoair LLC, Idaho Falls, ID (US)

(72) Inventors: Jason John Jones, Boise, ID (US); R. Jay Taylor, Idaho Falls, ID (US)

(73) Assignee: ECOAIR LLC, Idaho Falls, ID (US)

( * ) Notice: Subject to any disclaimer, the term of this patent is extended or adjusted under 35 U.S.C. 154(b) by 33 days.

(21) Appl. No.: 17/099,479

(22) Filed: Nov. 16, 2020

(51) Int. Cl.
*E03D 9/052* (2006.01)

(52) U.S. Cl.
CPC ..... *E03D 9/052* (2013.01)

(58) Field of Classification Search
CPC ..... E03D 9/052; E03D 9/05
USPC ..... 4/349
See application file for complete search history.

(56) References Cited

U.S. PATENT DOCUMENTS 629,709 A * 7/1899 Brickell ..... E03D 9/05 4/219
3,188,658 A * 6/1965 Dixon ..... E03D 11/02 4/215
4,318,192 A * 3/1982 Williams ..... E03D 9/052 4/351
5,029,346 A * 7/1991 Fernald, Sr. ..... E03D 9/052 4/348
5,123,125 A * 6/1992 Menge ..... E03D 9/052 4/213
5,125,119 A * 6/1992 Munoz ..... E03D 9/037 4/225.1
5,361,422 A * 11/1994 Vincent ..... E03D 9/05 4/216
5,606,747 A * 3/1997 Dupont ..... E03D 9/05 4/213
2002/0073482 A1* 6/2002 Hashemi ..... E03D 5/094 4/213
2006/0096013 A1* 5/2006 Dang ..... E03D 9/05 4/213
2009/0235441 A1* 9/2009 Spadola ..... E03D 9/052 4/213
2019/0323221 A1* 10/2019 Phonethepswath ..... E03D 9/052
2020/0141104 A1* 5/2020 Caulder ..... A47K 13/307

* cited by examiner

*Primary Examiner* — Benjamin R Shaw
(74) *Attorney, Agent, or Firm* — Parsons Behle & Latimer

(57) ABSTRACT

A toilet ventilation system may include a tank configured to fill with water to a threshold level. The system may also include a ventilation manifold having a manifold body, a first cavity defined in the manifold body that opens to an exterior of the manifold body through a first opening, a second cavity defined in the manifold body, where the second cavity is fluidly connected to the first cavity, where the second cavity opens to an exterior of the manifold body through a second opening, and where the second opening is blocked by the water when the tank is filled to the threshold level, and a third cavity defined in the manifold body, where the third cavity is fluidly connected to the second cavity, and where the third cavity opens to an exterior of the manifold body through a third opening.

20 Claims, 4 Drawing Sheets

SYSTEMS AND METHODS FOR TOILET VENTILATION

FIELD OF THE DISCLOSURE

This disclosure is generally related to the field of toilet ventilation and, in particular, to systems and methods for toilet ventilation using a ventilation manifold.

BACKGROUND

Toilets, in general, may provide for the safe and effective isolation and removal of solid and liquid waste. The mechanisms relied on by toilets to accomplish these goals may range from simple to very complex. Typical toilets may rely on gravitational effects and siphoning techniques to contain and transport waste to septic systems or to sewer systems. However, the solid and liquid waste may also be associated with gases and/or particle plumes that may create odors and, in some cases, may also create a health hazard.

External exhaust systems have been developed to reduce odors and other airborne particulates that may be associated with toilet use. These external exhaust systems typically use fans to create an airflow in the vicinity of the toilet and to transport the air away from a restroom, bathroom, water closet, or other location where the toilet may be situated. However, these external exhaust systems may be positioned in a ceiling or wall and at a distance from the source of the gases or particulates. Thus, it may take some time before the external exhaust system has a noticeable effect.

In some cases, ventilation systems may be incorporated into toilet systems themselves. In these cases, the toilet systems may include ventilation passages for moving odors out of the toilet directly. However, the close proximity of water to the ventilation passages, particularly during flushing, creates a risk that these ventilation systems may inadvertently suction water into the ventilation passages. In some cases, this could result decreased effectiveness and potential damage to ventilation components. Other disadvantages may exist.

SUMMARY

Disclosed herein is a toilet ventilation system that may overcome one or more disadvantages of typical toilet ventilation systems. In an embodiment, a toilet ventilation system includes a tank configured to fill with water to at least a threshold level. The system further includes an overflow tube positioned within the tank. The system also includes a fan assembly comprising an air input port and an air output port. The system includes a ventilation manifold that includes a manifold body, a first cavity defined in the manifold body, a second cavity defined in the manifold body, and a third cavity defined in the manifold body. The first cavity opens to an exterior of the manifold body through a first opening, where the first opening is connected to the overflow tube. The second cavity is fluidly connected to the first cavity, where the second cavity opens to the exterior of the manifold body through a second opening, and where the second opening is blocked by the water when the tank is filled to at least the threshold level. The third cavity is fluidly connected to the second cavity, where the third cavity opens to the exterior of the manifold body through a third opening, and where the third opening is connected to the air input port of the fan.

In some embodiments, the system includes a fill tube positioned within the first cavity of the ventilation manifold and configured to direct water into a flush channel through the overflow tube. In some embodiments, the fill tube is positioned within the overflow tube and at least partially within the flush channel. In some embodiments, the system includes a first sensor configured to detect a water level within the tank and to activate a motor of the fan assembly when the water reaches the threshold level and to deactivate the motor of the fan assembly when the water drops below the threshold level. In some embodiments, the system includes a second sensor configured detect a presence or a non-presence of a user and to activate a motor of the fan assembly when the presence of the user is detected and to deactivate the motor of the fan assembly when the non-presence of the user is detected. In some embodiments, the motor is a 12-volt direct-current (DC) motor. In some embodiments, the air output port of the fan assembly is connected to a lower passage of a toilet bowl structure. In some embodiments, the system includes a polypropylene corrugated hose connecting the air output port to the lower passage. In some embodiments, the fan assembly further comprises a one-way check valve.

In an embodiment, a toilet ventilation method includes providing a ventilation manifold. The ventilation manifold includes a manifold body. The ventilation manifold further includes a first cavity defined in the manifold body, where the first cavity opens to an exterior of the manifold body through a first opening. The ventilation manifold also includes a second cavity defined in the manifold body, where the second cavity is fluidly connected to the first cavity, and where the second cavity opens to the exterior of the manifold body through a second opening. The ventilation manifold includes a third cavity defined in the manifold body, where the third cavity is fluidly connected to the second cavity, and where the third cavity opens to the exterior of the manifold body through a third opening. The method further includes filling a tank with water to at least a threshold level, where the second opening of the ventilation manifold is blocked by the water when the tank is filled to at least the threshold level. The method also includes creating suction between the first opening of the ventilation manifold and the third opening of the ventilation manifold while the second opening of the ventilation manifold is blocked. The method includes flushing at least a portion of the water from the tank, where flushing at least the portion of the water from the tank exposes the second opening, and where exposing the second opening prevents suction between the first opening and the third opening.

In some embodiments, creating the suction between the first opening and the third opening comprises activating a motor of a fan assembly, where the fan assembly includes an air input port and an air output port, where the third opening is connected to the air input port. In some embodiments, the method includes detecting a water level within the tank, activating the motor of the fan assembly in response to the water reaching the threshold level, and deactivating the motor of the fan assembly in response to the water dropping below the threshold level. In some embodiments, the method includes detecting a presence or a non-presence of a user, activating the motor of the fan assembly in response to detecting the presence of the user, and deactivating the motor of the fan assembly in response to detecting the non-presence of the user. In some embodiments, activating the motor is delayed by a first period of time after detecting the presence of the user, and where deactivating the motor is delayed by a second time period after detecting the non-presence of the user. In some embodiments, the suction between the first opening of the ventilation manifold and the third opening of the ventilation manifold draws air from a bowl, through a rim chamber, through a flush channel, and through an overflow tube connected to the first opening. In some embodiments, the method includes filling a bowl with water using a fill tube, where the fill tube positioned within the first cavity of the ventilation manifold. In some embodiments, the fill tube is positioned within the overflow tube and at least partially within the flush channel.

In an embodiment, a ventilation manifold for toilet ventilation includes a manifold body. The manifold body further includes a first cavity defined in the manifold body, where the first cavity opens to an exterior of the manifold body through a first opening, and where the first opening is configured to connect to an overflow tube within a tank. The manifold body further includes a second cavity defined in the manifold body, where the second cavity is fluidly connected to the first cavity, where the second cavity opens to the exterior of the manifold body through a second opening, and where the second opening is blocked by water when the tank is filled to at least a threshold level. The manifold body also includes a third cavity defined in the manifold body, where the third cavity is fluidly connected to the second cavity, where the third cavity opens to the exterior of the manifold body through a third opening, and where the third opening is configured to connect to the air input port of a fan assembly.

In some embodiments, the second opening being blocked by water enables suction between the first opening of the ventilation manifold and the third opening of the ventilation manifold. In some embodiments, the suction enables air to be drawn from a bowl, through a rim chamber, through a flush channel, and through an overflow tube connected to the first opening.

Figure 1:
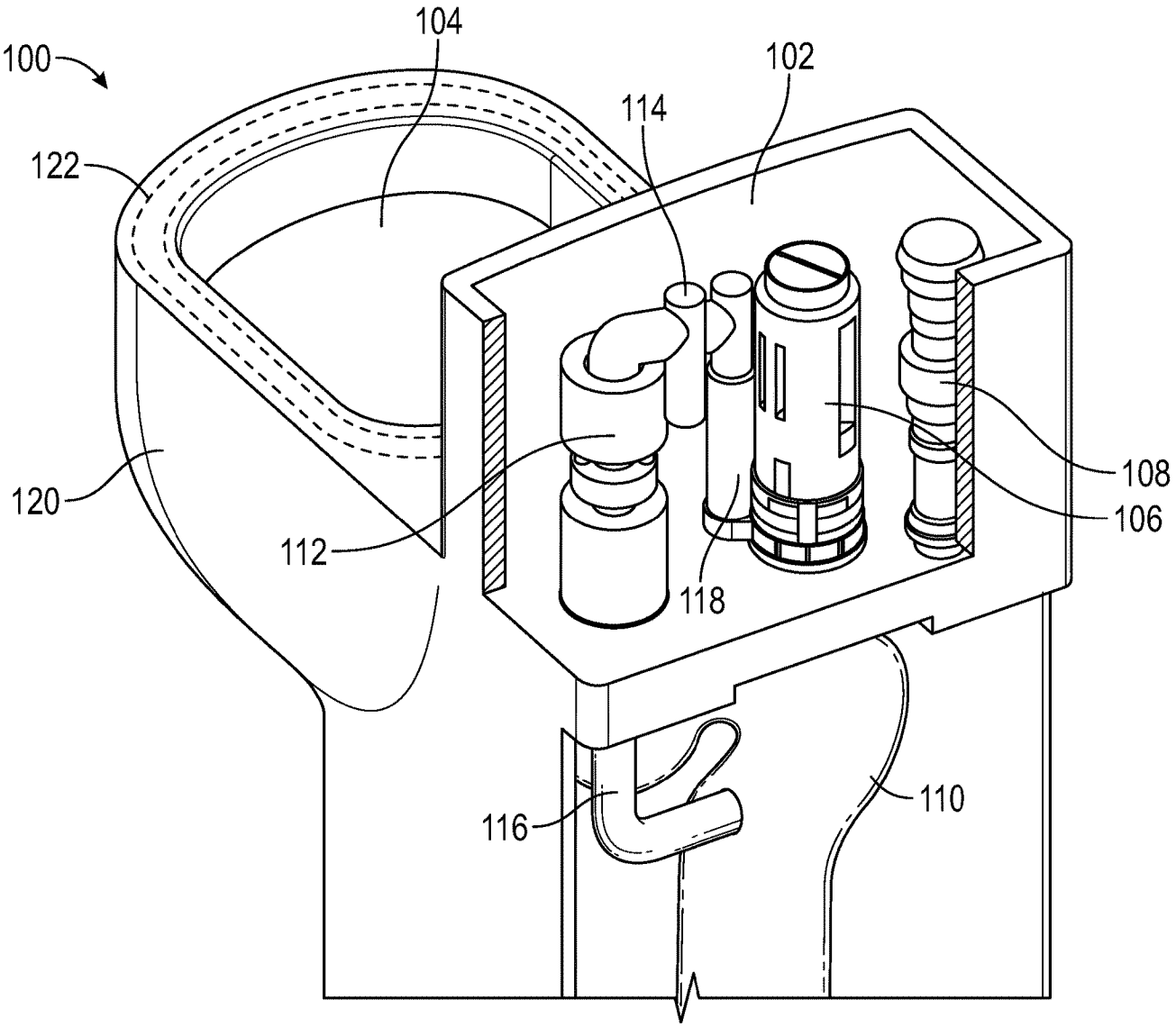
FIG. 1 is a perspective view of an embodiment of a toilet ventilation system including a cutaway view of a portion of the toilet ventilation system.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure.

DETAILED DESCRIPTION

Described herein is a toilet ventilation system that may rely on a ventilation manifold positioned within a tank of a toilet. When a water level in the tank is at a threshold level, an opening of the manifold may be sealed by the water, which enables suction to be created to draw air from a bowl of the toilet through a rim chamber, through a fan assembly, and ultimately into a lower passage of the toilet for introduction into a sewer or septic system. When the water level drops below the threshold level (such as when the toilet is flushed), the opening of the manifold is unsealed and suction within the manifold is immediately eliminated. By eliminating the suction within the ventilation manifold, the rim chamber may be used to introduce flush water into the bowl without the flush water being sucked into the fan assembly. Thus, the rim chamber may be used both for drawing air out of the bowl and for introducing water into the bowl. The ventilation manifold may regulate these multiple functions to ensure they do not occur simultaneously.

Referring to FIG. 1, an embodiment of a toilet ventilation system 100 is depicted. The system 100 may include a tank 102 and a bowl 104. The tank 102 may be positioned above the bowl 102 and may be filled with water to a threshold level. The water may be periodically flushed from the tank 102 into the bowl 104 and further into a lower passage 110 in order to generate a force to push and/or pull solid and liquid waste from the bowl 104 into the lower passage 110. The lower passage 110 may include a P-trap, an S-bend, a U-bend, another type of self-sealing pipe structure, or combinations thereof to prevent gas and/or airborne particles from returning to the bowl from the lower passage 110. The lower passage 110 may also connect to a wastewater system, such as a sewer or septic system. After being pushed and/or pulled from the bowl 104, the water may be introduced into the sewer or septic system via the lower passage 110.

The tank 102 may include a flush valve 106, a fill valve 108, and an overflow tube 118 installed therein. The flush valve 106 may be actuated by a user to flush the water from the tank 102 into the bowl 104 and into the lower passage 110. For example, upon actuation via a handle, chain, or combination thereof, the flush valve 106 may fluidly connect the tank 102 to a flush channel. The flush channel may be connected to a rim chamber 122 positioned within a rim 120 of the bowl 104. The flush channel may also be fluidly connected to the lower passage 110. Water may simultaneously fill the rim chamber 122 and the lower passage 110. The rim chamber 122 may include outlets (or jets) that permit the water to enter the bowl, thereby loosening solid waste and pushing it into the lower channel 110. The water that flows into the lower channel 110 may create a siphoning effect as it flows into a sewer system or other type of septic system and may pull waste from the bowl 104 along with it. The flush valve 106 may be a canister valve as shown in FIG. 1 or, in some cases, the flush valve 106 may be a flapper valve as depicted elsewhere in this disclosure. Other types of valves may also be used.

The fill valve 108 may be configured to refill the tank 102 with water after each flush. When the water reaches the threshold level, the fill valve 108 may shut off automatically. The fill valve 108 may use a float (not shown) or another type of fill detection mechanism to determine when to shut off. In some toilet systems, the fill valve 108 may include a fill tube used to introduce water into the bowl 104 and lower passage 110 through the overflow tube 118. The fill tube may fill the bowl 104 with fresh water at a low rate of flow in order to avoid a secondary siphoning effect after flushing.

The overflow tube 118 may be fluidly connected to a flush channel below the flush valve 106 and may bypass the flush valve 106. Between flushes, the fill tube 118, the rim chamber 122, and any flush channels between them may be devoid of significant amounts of water. As such, they may provide air access from the bowl 104 to a top of the overflow tube 118.

The system 100 may include a fan assembly 112 and a ventilation manifold 114. The fan assembly 112 may include a motorized fan and one or more check valves. When operating, the fan assembly 112 may draw air from the overflow tube 118, through the ventilation manifold 114, and through the fan assembly 112. The air may be pumped through a hose 116 and into the lower passage 110. As described above, the lower passage 110 may be sealed via a P-trap, an S-bend, or a U-bend to prevent air from passing back into the bowl 104 or from escaping into the space around the toilet system 100.

Between flushes, when a water level in the tank is at a threshold level, an opening of the ventilation manifold 114 may be sealed by the water. This may enable the fan assembly 112 to create suction within the ventilation manifold 114 to draw air from the bowl 104 through the rim chamber 122. During a flush, the water level may drop below the threshold level thereby unsealing the opening of the manifold. Suction within the manifold may be immediately eliminated.

An advantage of the system 100 is that, by eliminating the suction within the ventilation manifold 114, the rim chamber 122 may be used to introduce flush water into the bowl 104 without the flush water being sucked into the fan assembly 112. Other advantages may exist.

Figure 2:
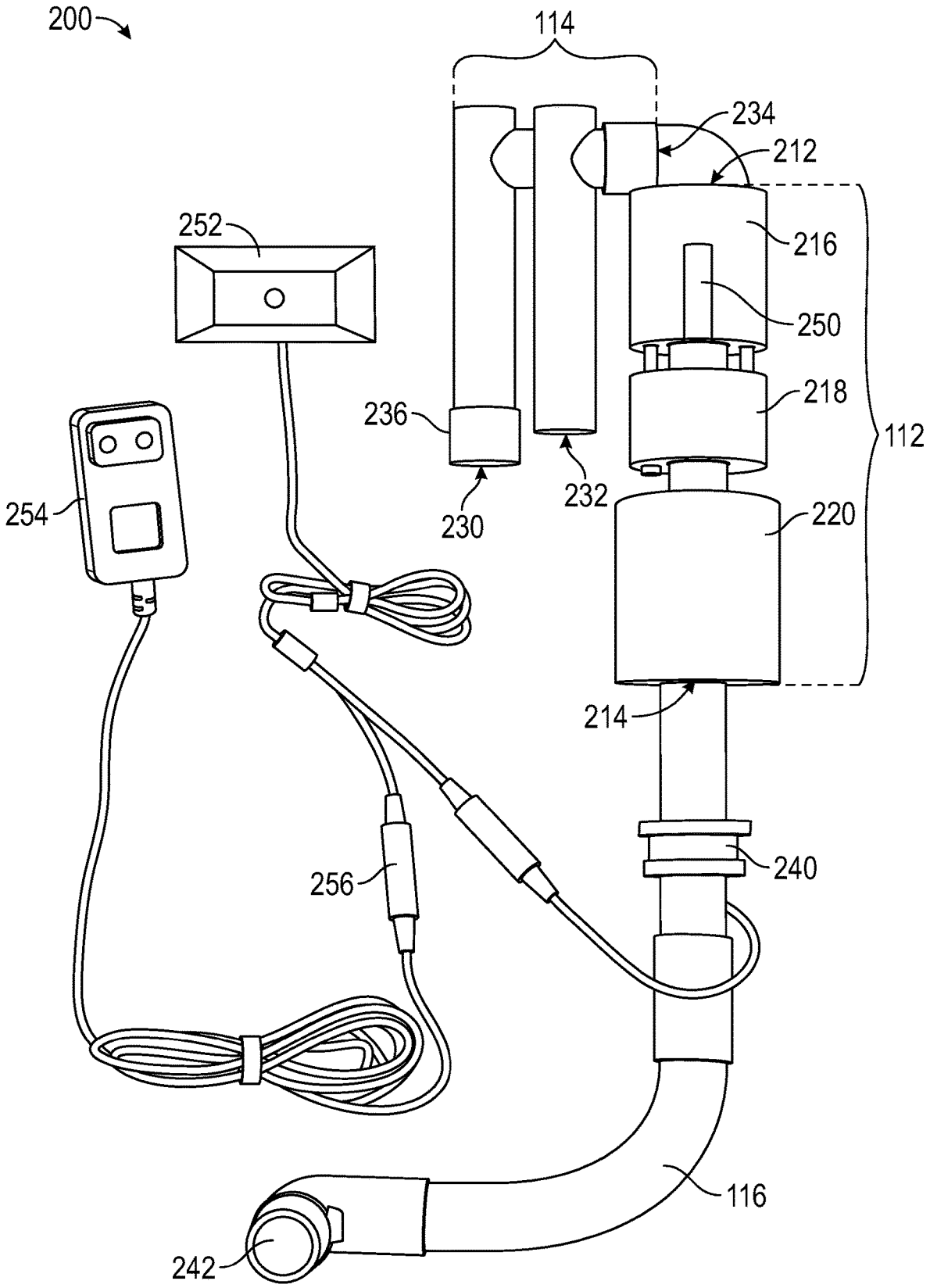
FIG. 2 is a depiction of a portion of an embodiment of a toilet ventilation system for installation in a toilet.

Referring to FIG. 2, an embodiment of a toilet ventilation system 200 for installation in a toilet is depicted. Portions of the toilet ventilation system 200 may correspond to similar portions of the ventilated toilet system 100. For example, the toilet ventilation system 200 may include a fan assembly 112, a ventilation manifold 114, and a hose 116.

The fan assembly 112 may include a first check valve 216, a second check valve 218, and a motor 220. Together the check valves 216, 218 may prevent odors from returning to the ventilation manifold 114 after being drawn into the fan assembly 112. At least one of the check valves 216, 218 may include a float valve. Although FIG. 2 depicts two check valves 216, 218, some embodiments may include fewer or more than two check valves.

The motor 220 may be used to create suction when activated to move the air. In some embodiments, the motor 220 may include a 12-volt, 8-watt, direct current (DC) energy saving motor, having a 3-watt average annual power consumption. During operation, air may be drawn into the fan assembly 112 through an air input port 212 and expelled through an air output port 214. A power supply 254 may provide power to the motor 220 and other electronic components of the system 200. The power supply 254 may be a 12-volt DC power supply.

The ventilation manifold 114 may include a first opening 230 configured to connect to an overflow tube (such as the overflow tube 118 of FIG. 1). A seal 236 may enable an airtight connection between the overflow tube and the ventilation manifold 114. The ventilation manifold may further include a second opening 232. The second opening 232 may be positioned such that when a tank is filled to a threshold level, the second opening 232 is blocked by water. With the second opening 232 blocked, suction may be enabled between the first opening 230 and a third opening 234 that may be connected to the air input port 212 of the fan assembly 112. When the water level drops below a threshold level, the second opening 232 may be unblocked and suction between the first opening 230 and the third opening 234 may be eliminated. The operation of the ventilation manifold is further described herein.

The system 200 may include a first sensor 250 and a second sensor 252. The first sensor 250 may detect a water level within a tank. The motor 220 may be deactivated when the first sensor 250 detects no water. Thus, when a flush occurs, the motor 220 may be stopped. Even with the motor 220 stopped some suction may still exist within the ventilation manifold 114. However, as described herein the second opening 232 of the ventilation manifold 114 may be unblocked and allow unrestricted air access, which may eliminate the suction.

The second sensor 252 may be configured detect a presence or a non-presence of a user and to activate the motor 220 of the fan assembly 112 when the presence of the user is detected and to deactivate the motor 220 of the fan assembly 112 when the non-presence of the user is detected. In particular, the motor 220 may be configured to start in about 4 seconds after the presence of a user is detected and may be configured to shut off about 12 seconds after the non-presence of a user is detected. In this way, the fan assembly 112 may provide ventilation while a toilet system is in use and may deactivate after use. In some embodiments, a switch may be used rather than a sensor. Other configurations are possible. One or more waterproof connectors 256 may provide power from the power supply 254 to the sensors 250, 252 and the motor 220.

The system 200 may be configured for insertion into a tank, such as the tank 102 of FIG. 1. In order to prevent leakage from the tank, the system 200 may include a tank seal 240. The tank seal 240 may enable the fan assembly 112, within the tank, to connect to the hose 116, outside the tank, while sealing an access hole in a surface of the tank. The hose 116 may be a polypropylene corrugated hose and may connect the air output port 214 of the fan assembly 112 to a lower passage of a toilet system, such as the lower passage 110. The hose may be positioned after an s-bend in the lower passage 110 to prevent air from returning to a bowl of the toilet system. A connection opening 242 may facilitate connection of the hose 116 to the lower passage 110.

Figure 3:
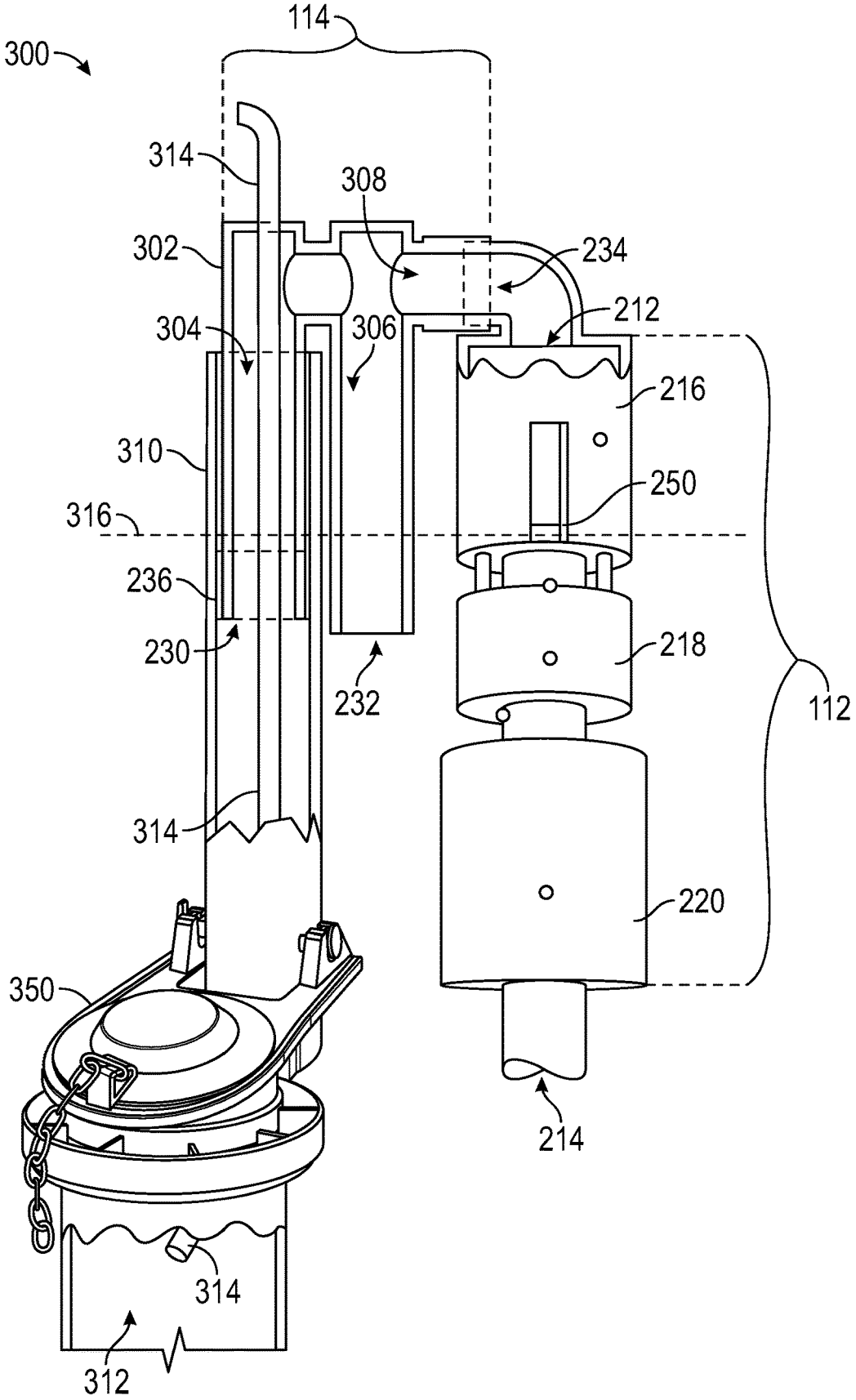
FIG. 3 is a depiction including a cutaway view of an embodiment of a ventilation manifold coupled to an embodiment of a toilet ventilation system.

Referring to FIG. 3, an embodiment of a ventilation manifold 114 coupled to an embodiment of a toilet ventilation system 300 is depicted. In FIG. 3, the ventilation manifold 114 is presented as a cutaway view to facilitate discussion of its function. The system 300 may include the fan assembly 112, the ventilation manifold 114, and a flusher valve 350.

As described herein, the fan assembly 112 may include the check valves 216, 218 and a motor 220 to provide for one-way air movement from the air inlet 212 to the air outlet 214. The first sensor 250 may be attached to the fan assembly 112. In some embodiments, the first sensor 250 may be attached elsewhere in a tank. The flush valve 350 may be a flapper valve, as depicted, or another type of valve. The flush valve 350 may be actuated to open fluid communication between a tank in which the system 300 may be positioned and a flush channel 312. The fluid communication may be cut off automatically when most of the water has been drained from the tank.

An overflow tube 310 may be configured to bypass the flush valve 350 to provide direct access to the flush channel 312. A top of the overflow tube 310 may extend above a threshold water level 316. The threshold water level 316 may be a level at which water may fill a tank in which the system 300 is positioned as described with reference to FIG. 1.

The ventilation manifold 114 may include a manifold body 302 having a first cavity 304, a second cavity 306, and a third cavity 308 defined therein. The first cavity 304 may open to an exterior of the manifold body 302 through the first opening 230. The first opening 230 may be configured to connect to the overflow tube 310. For example, the first opening 230 may be inserted into the overflow tube 310 and the seal 236 may create an airtight passage extending from the flush channel 312 into the first cavity 304.

The second cavity 306 defined in the manifold body 302 may be fluidly connected to the first cavity 304 and may open to an exterior of the manifold body 302 through the second opening 232. As described herein, the second opening may be blocked by water when the tank is filled to at least the threshold level 316.

The third cavity 308 defined in the manifold body 302 may be fluidly connected to the second cavity 306 and may open to an exterior of the manifold body 302 through the third opening 234. The third opening 234 may be connected to the air input port 212 of the fan assembly 112.

The system 300 may further include a fill tube 314 positioned within the first cavity 304 of the ventilation manifold and configured to direct water into the flush channel 312 through the overflow tube 310. The fill tube 314 may run along the length of the overflow tube 310 and may extend at least partially within the flush channel 312 past the flush valve 350. The fill tube may enable refilling of a toilet bowl and S-bend without the risk of introducing water into the fan assembly 112.

During operation, a tank, such as the tank 102 depicted in FIG. 1, may be filled to a threshold level 316 depicted in FIG. 3. At the threshold level 316, the water may be detected by the first sensor 250. The first sensor 250, upon detection of water, may activate the motor 220 of the fan assembly 112. In some embodiments, activation of the motor 220 may further depend on detection of a user by a second sensor and/or actuation of a power switch. While activated, the motor 220 may cause the fan assembly to draw air into the air input port 212 from the third opening 234 of the ventilation manifold 114. While the second opening 232 is blocked by water, suction may be generated by the fan assembly 112 that draws air from the flush channel 312 through the overflow tube 310, and through the first cavity 304 and the third cavity 308. Further, the flush channel 312 may be coupled to a rim chamber, such as the rim chamber 122 of FIG. 1. Thus, air may be drawn from the bowl 104 by the fan assembly 112.

During a flush, the water level may drop below the threshold level 316. In response to detecting no water, the first sensor 250 may deactivate the motor 220 stopping the fan assembly 112 from drawing additional air. Further, the second opening 232 may be unblocked by water to eliminate suction within the ventilation manifold 114 between the first cavity 304 and the third cavity 308. As the tank refills to the threshold level 316, suction may be reestablished within the ventilation manifold 114 and the motor 220 may be reactivated when the first sensor 250 detects water.

Figure 4:
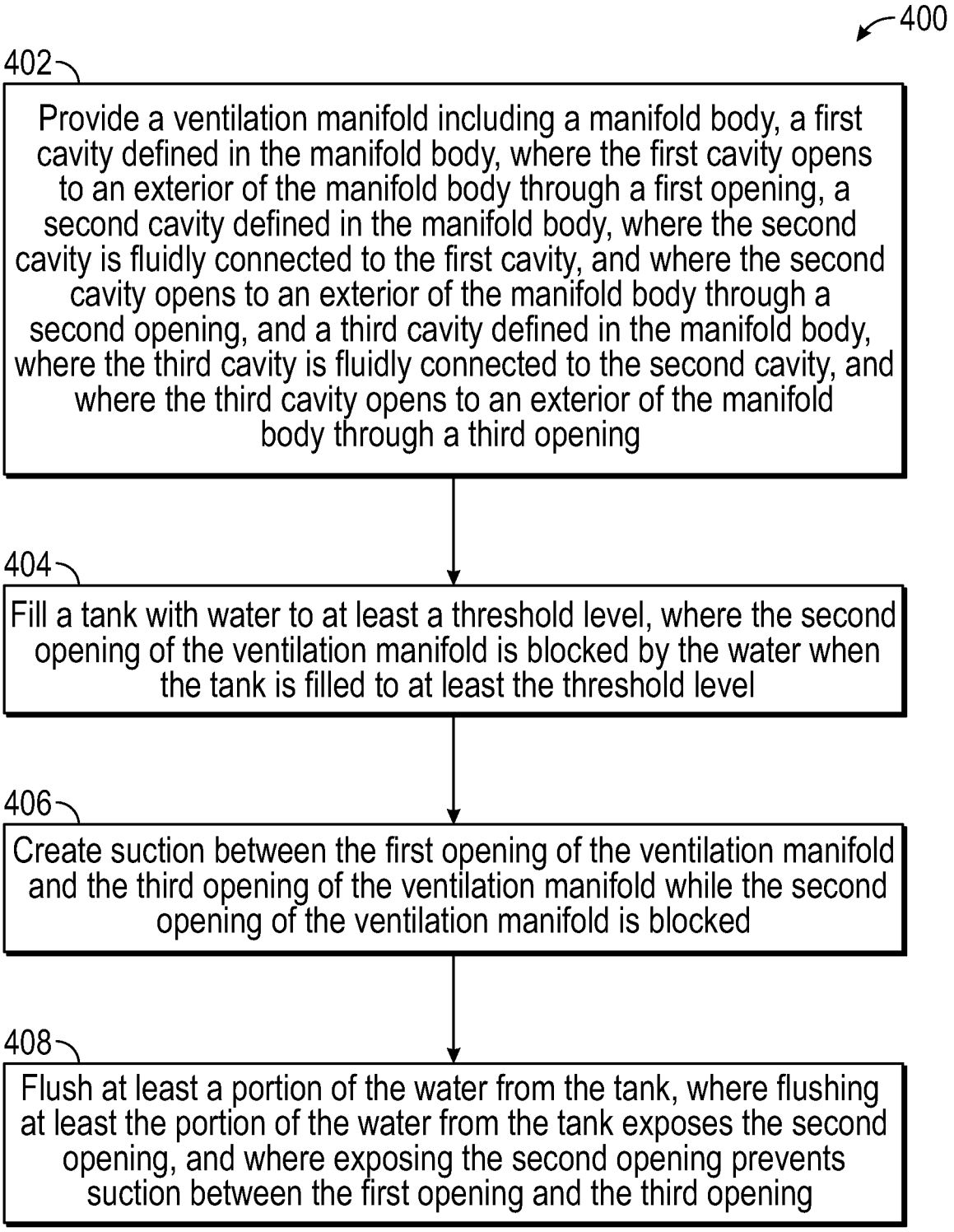
FIG. 4 is a flowchart depicting an embodiment of a method for toilet ventilation.

Referring to FIG. 4, an embodiment of a method 400 for toilet ventilation is depicted. The method 400 may include providing a ventilation manifold including a manifold body, a first cavity defined in the manifold body, where the first cavity opens to an exterior of the manifold body through a first opening, a second cavity defined in the manifold body, where the second cavity is fluidly connected to the first cavity, and where the second cavity opens to an exterior of the manifold body through a second opening, and a third cavity defined in the manifold body, where the third cavity is fluidly connected to the second cavity, and where the third cavity opens to an exterior of the manifold body through a third opening, at 402. For example, the ventilation manifold 114 may be provided within the tank 102.

The method 400 may further include filing a tank with water to at least a threshold level, where the second opening of the ventilation manifold is blocked by the water when the tank is filled to at least the threshold level, at 404. For example, the tank 102 may be filled to the threshold level 316 and the second opening 232 of the ventilation manifold 114 may be blocked.

The method 400 may also include creating suction between the first opening of the ventilation manifold and the third opening of the ventilation manifold while the second opening of the ventilation manifold is blocked, at 406. For example, suction may be created between the first opening 230 and the third opening 234 by the fan assembly 112.

The method 400 may include flushing at least a portion of the water from the tank, where flushing at least the portion of the water from the tank exposes the second opening, and where exposing the second opening prevents suction between the first opening and the third opening, at 408.

A benefit of the method 400 is that by eliminating the suction within the ventilation manifold 114, the risk of sucking water into the fan assembly 112 may be eliminated during flushing. Other advantages may exist.

Although various embodiments have been shown and described, the present disclosure is not so limited and will be understood to include all such modifications and variations as would be apparent to one skilled in the art.

What is claimed is:

1. A toilet ventilation system comprising:

a tank configured to fill with water to at least a threshold level;

an overflow tube positioned within the tank;

a fan assembly comprising an air input port and an air output port; and a ventilation manifold comprising:

a manifold body;

a first cavity defined in the manifold body, wherein the first cavity opens to an exterior of the manifold body through a first opening, wherein the first opening is connected to the overflow tube;

a second cavity defined in the manifold body, wherein the second cavity is fluidly connected to the first cavity, wherein the second cavity opens to the exterior of the manifold body through a second opening, and wherein the second opening is blocked by the water when the tank is filled to at least the threshold level; and a third cavity defined in the manifold body, wherein the third cavity is fluidly connected to the second cavity, wherein the third cavity opens to the exterior of the manifold body through a third opening, and wherein the third opening is connected to the air input port of the fan.

2. The system of claim 1, further comprising a fill tube positioned within the first cavity of the ventilation manifold and configured to direct water into a flush channel through the overflow tube.

3. The system of claim 2, wherein the fill tube is positioned within the overflow tube and at least partially within the flush channel.

4. The system of claim 1, further comprising a first sensor configured to detect a water level within the tank and to activate a motor of the fan assembly when the water reaches the threshold level and to deactivate the motor of the fan assembly when the water drops below the threshold level.

5. The system of claim 1, further comprising a second sensor configured detect a presence or a non-presence of a user and to activate a motor of the fan assembly when the presence of the user is detected and to deactivate the motor of the fan assembly when the non-presence of the user is detected.

6. The system of claim 5, wherein the motor of the fan assembly is a 12-volt direct-current (DC) motor.

7. The system of claim 1, wherein the air output port of the fan assembly is connected to a lower passage of a toilet bowl structure.

8. The system of claim 7, further comprising a polypropylene corrugated hose connecting the air output port to the lower passage.

9. The system of claim 1, wherein the fan assembly further comprises a one-way check valve.

10. A toilet ventilation method comprising:

filling a tank of a toilet system with water to at least a threshold level, wherein the toilet system includes a ventilation manifold comprising:

a manifold body;

a first cavity defined in the manifold body, wherein the first cavity opens to an exterior of the manifold body through a first opening;

a second cavity defined in the manifold body, wherein the second cavity is fluidly connected to the first cavity, and wherein the second cavity opens to an exterior of the manifold body through a second opening; and a third cavity defined in the manifold body, wherein the third cavity is fluidly connected to the second cavity, wherein the third cavity opens to an exterior of the manifold body through a third opening; wherein the second opening of the ventilation manifold is blocked by the water when the tank is filled to at least the threshold level; and creating suction between the first opening of the ventilation manifold and the third opening of the ventilation manifold while the second opening of the ventilation manifold is blocked; and flushing at least a portion of the water from the tank, wherein flushing at least the portion of the water from the tank exposes the second opening, and wherein exposing the second opening prevents suction between the first opening and the third opening.

11. The method of claim 10, wherein creating the suction between the first opening and the third opening comprises activating a motor of a fan assembly, wherein the fan assembly includes an air input port and an air output port, wherein the third opening is connected to the air input port.

12. The method of claim 11, further comprising:

detecting a water level within the tank;

activating the motor of the fan assembly in response to the water reaching the threshold level; and deactivating the motor of the fan assembly in response to the water dropping below the threshold level.

13. The method of claim 11, further comprising:

detecting a presence or a non-presence of a user;

activating the motor of the fan assembly in response to detecting the presence of the user; and deactivating the motor of the fan assembly in response to detecting the non-presence of the user.

14. The method of claim 13, wherein activating the motor is delayed by a first period of time after detecting of the presence of the user, and wherein deactivating the motor is delayed by a second time period after detecting the non-presence of the user.

15. The method of claim 10, wherein the suction between the first opening of the ventilation manifold and the third opening of the ventilation manifold draws air from a bowl, through a rim chamber, through a flush channel, and through an overflow tube connected to the first opening.

16. The method of claim 11, further comprising filling a bowl with water using a fill tube, wherein the fill tube positioned within the first cavity of the manifold.

17. The method of claim 16, wherein the fill tube is positioned within an overflow tube connected to the first opening and at least partially within the flush channel.

18. A ventilation manifold for toilet ventilation, the ventilation manifold comprising:

a manifold body;

a first cavity defined in the manifold body, wherein the first cavity opens to an exterior of the manifold body through a first opening, wherein the first opening is configured to connect to an overflow tube within a tank;

a second cavity defined in the manifold body, wherein the second cavity is fluidly connected to the first cavity, wherein the second cavity opens to an exterior of the manifold body through a second opening, and wherein the second opening is blocked by water when the tank is filled to at least a threshold level; and a third cavity defined in the manifold body, wherein the third cavity is fluidly connected to the second cavity, wherein the third cavity opens to an exterior of the manifold body through a third opening, and wherein the third opening is configured to connect to an air input port of a fan assembly.

19. The ventilation manifold of claim 18, wherein the second opening being blocked by water enables suction between the first opening of the ventilation manifold and the third opening of the ventilation manifold.

20. The ventilation manifold of claim 19, wherein the suction enables air to be drawn from a bowl, through a rim chamber, through a flush channel, and through the overflow tube.

* * * * *